United States Patent [19]

Hanley

[11] 4,111,471

[45] Sep. 5, 1978

[54] MACRAME RACK APPARATUS

[76] Inventor: Don N. Hanley, 100 Hilltop Dr. #14, Redding, Calif. 96001

[21] Appl. No.: 763,006

[22] Filed: Jan. 27, 1977

[51] Int. Cl.[2] ..... B65H 69/04

[52] U.S. Cl. ..... 289/18; 108/152; 248/460

[58] Field of Search ..... 28/15, 149; 289/18; 248/460; 108/144, 151, 152

[56] References Cited

U.S. PATENT DOCUMENTS

| | | | |
|---|---|---|---|
| 114,279 | 5/1871 | Elliott | 108/152 |
| 248,669 | 10/1881 | Sackett | 28/149 |
| 2,508,694 | 5/1950 | Steed | 248/460 X |
| 3,250,235 | 5/1966 | McDonnell | 108/152 |
| 3,637,172 | 1/1972 | Diesbach | 248/460 |
| 3,983,823 | 10/1976 | McDonnell | 108/152 |
| 4,003,592 | 1/1977 | Schreues | 289/18 |
| 4,029,347 | 6/1977 | Garcia | 289/18 |

OTHER PUBLICATIONS

"Building Craft Equipment," by A. J. and C. W. Abrams; Praeger Publishes, N.Y. 1976, pp. 112–114.

*Primary Examiner*—Louis K. Rimrodt
*Attorney, Agent, or Firm*—H. Gordon Shields

[57] ABSTRACT

Macrame rack apparatus is disclosed which includes movable pins for measuring macrame cord and a plurality of hooks for holding the cord and a removable work table for working with different types of macrame projects.

5 Claims, 8 Drawing Figures

MACRAME RACK APPARATUS

BACKGROUND OF THE INVENTION

1. Field of the Invention

This invention relates to rack apparatus for holding macrame cord, and, more particularly, to rack apparatus for holding and measuring the cord used for macrame projects, in which the holding and measuring apparatus are movable to adjust for the size of the macrame project.

2. Description of the Prior Art

Macrame cord and macrame lace projects, while receiving a revival in interest in recent years, is not a new skill, but rather goes back for many years. For example, several types of desks or macrame looms have been patented. U.S. Pat. No. 254,258 and U.S. Pat. No. 254,288 disclose two examples of prior art desks for macrame lace.

U.S. Pat. No. 3,688,357 discloses another type of macrame apparatus, referred to in the patent as a macrame loom. All three of the patents disclose pin arrangements for holding macrame cord while working with the cord. The desks or looms are primarily usable for smaller macrame projects, and do not lend themselves conveniently for use in longer, or more lengthy, macrame projects. For longer projects, such as making hangers for potted plants, the length of the project is governed only by the desires of the user. Heretofore, a user has generally typically juryrigged a hanger of some type from which to suspend the cords while working with the cords to complete the macrame project. In some cases, this has required that the project be accomplished in a standing position, and in other cases the project has been enabled to be completed while in the sitting position. However, at best the juryrigged apparatus have been but a stop gap measure for the convenience of a particular macrame enthusiast.

The apparatus of the present invention provides a rack from which the macrame cords may be conveniently hung or suspended, and which may be moved, as the project lengthens. Moreover, movable pins are provided for measuring the cord so that the user may conveniently premeasure the amount of cord required for a given project.

The user of the macrame rack may remain seated in a convenient and comfortable position while accomplishing the macrame project by suspending the work from the rack, and by moving the work upwardly on the rack as the project progresses. A work table, removable from the rack, is also provided to accommodate the user for certain macrame projects.

SUMMARY OF THE INVENTION

The apparatus disclosed herein comprises a rack which includes a vertical member or rod having a plurality of horizontally extending ends spaced apart and movable with respect to the vertical rod for measuring the length of cord used for macrame projects, and movable hooks for holding the cord, and the macrame project, as the project is accomplished. A removable table is also provided by the apparatus for conveniently locating macrame projects for the user of the apparatus.

Among the objects of the present invention are the following:

To provide new and useful rack apparatus;

To provide new and useful apparatus for holding cord;

To provide new and useful apparatus for measuring and holding cords for macrame projects;

To provide new and useful apparatus having a removable work table for holding cord for macrame projects;

To provide new and useful macrame holding apparatus.

DESCRIPTION OF THE PREFERRED EMBODIMENT

Figure 1:
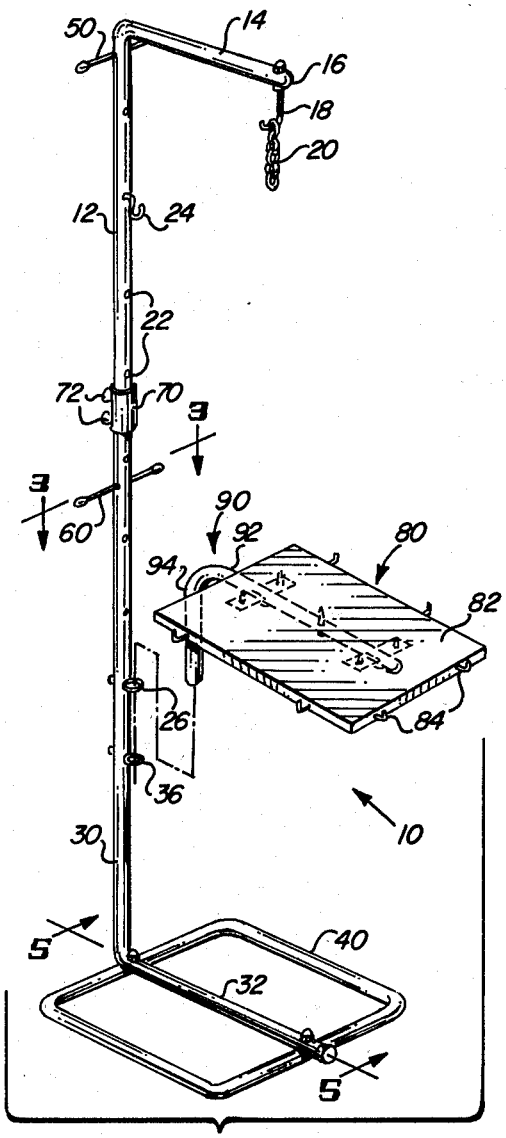
FIG. 1 is a perspective view of the rack apparatus of the present invention.

FIG. 1 is a perspective view of macrame rack apparatus 10 of the present invention. The rack apparatus 10 includes an upper tubing element 12 and a lower tubing element 30. The outer diameter of the upper and lower tubing element 12 and 30 are preferably the same, and a sleeve 70 whose inside diameter is the same as the outer diameter of the upper and lower tubing is used to secure the two tubular elements together. Below the juncture of the upper and lower tubings are a pair of eye bolts 26 and 36, which serve to hold a work table 80 to the rack 10.

At the upper or top end of the rack, the upper tubing 12 includes a horizontally extending arm 14, which terminates in an end portion 16. A hook 18 extends through an aperture in the end portion 16, and a chain 20 hangs downwardly from the hook. The hook is appropriately secured to the arm 14. The length of the chain may be adjusted by simply changing the link of the chain hanging on the bolt.

Figure 5:
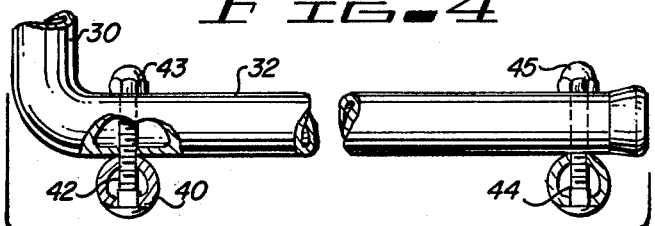
FIG. 5 is an enlarged side view of a portion of the apparatus of FIG. 1 taken generally along line 5—5 of FIG. 1.

At the bottom of the rack apparatus, the lower tubing 30 includes a horizontally extending leg 32, which is substantially parallel to the upper arm 14. The horizontal leg 32 is secured to a base 40. The base 40 is a square piece of tubing which is fastened to the horizontal leg 32 by appropriate means, such as by a pair of bolts, as discussed below and as illustrated in FIG. 5.

Extending substantially perpendicular to the arm 14 are two measuring pins 50 and 60. The measuring pin 50 is disposed adjacent the horizontal arm 14, and the measuring pin 60 is spaced downwardly from the pin 50. The pin 60 is spaced apart from the pin 50 by a distance of three feet. The measuring pins preferably comprise rods which extend through a pair of diametrically extending apertures through the upper tubing 12 and in which apertures the respective rods are movable.

The rods may be used to measure the length of cord for any particular macrame project. By using the two rods, various measurements may be easily accomplished. For example, the distance between measuring rod 50 and measuring rod 60 is 3 feet, and a single loop around the two rods is about 6 feet. Seven loops around the measuring rods 50 and 60 accordingly measure about 42 feet. In FIG. 1, the pins 50 and 60 are illustrated as being disposed substantially centrally with respect to the upper tubing 12. However, the user of the apparatus may move the pins to either side for convenience in measuring.

A plurality of apertures or holes 22 are shown extending through the upper tubing 12 and the lower tubing 30 substantially perpendicular to the apertures through which the measuring pins extend. The holes 22 are preferably spaced about 8 inches apart downwardly from adjacent the horizontal arm 14. A hook 24 is shown disposed in one of the apertures 22. The macrame cord may be secured to the hook 24 at a convenient location on the vertically extending tubing. As the macrame project continues, the hook 24, with the macrame project secured thereto, may be raised by removing the hook from one of the apertures 22 and inserting it into another, higher, aperture 22 in the upper tubing 12. The work accordingly remains at a most convenient height for the user.

As indicated above, the upper tubing and the lower tubing are secured together by a sleeve 70 into which the lower portion of the upper tubing and the upper portion of the lower tubing are inserted. A pair of thumb screws 72 are used to secure the sleeve to the tubing portions.

Below the sleeve 70 and the measuring pin 60 are the eye bolts 26 and 36. The eye bolts are in parallel alignment with respect to each other, and the "eyes" of the eye bolts extend forwardly with respect to the vertically extending tubing. The eye bolts are also generally parallel to the horizontal arm 14 and the horizontal leg 32, both of which are generally perpendicular to the measuring pins 50 and 60.

The work table 80 includes a rectangularly configured, generally flat or planar board 82 secured to tubing 90. The tubing 90 includes a long portion 92 (see FIG. 4) and a short portion 94 which extends into the eyes of the bolts 26 and 36. The table 80 is thus conveniently secured to and removed from the rack 10, as desired.

The work table 80 receives a macrame board on the top of the table, and the board is held in place by a plurality of L-shaped pins 84 disposed on the periphery of the side edges of the board 80 and at the front end of the board 80, which is facing the user of the apparatus and remote from the short end 94 of the tubing 90. The pins 84 are preferably screwed into the edges of the board 82, which is preferably made of wood. Limited height and angular adjustment may be accomplished with respect to the table 80 by inserting the short tubing 94 more or less downwardly or upwardly with respect to the eye bolts 26 and 36.

Figure 2:
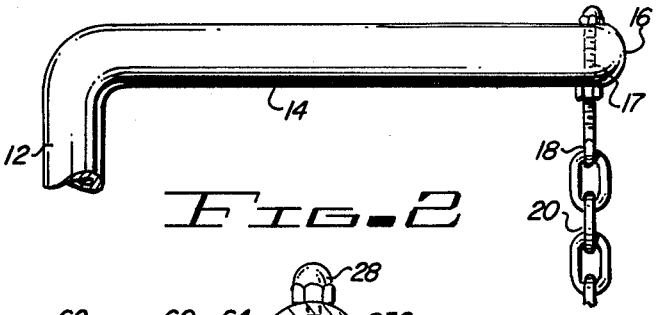
FIG. 2 is an enlarged side view of a portion of the apparatus of FIG. 1.

FIG. 2 is an enlarged side view of a portion of the apparatus of FIG. 1. It comprises a side view of the upper horizontally extending arm 14.

The arm 14 extends substantially perpendicular to the upper tubing 12. The arm 14 terminates in an end portion 16, through which an aperture 17 extends. The aperture 17 receives a threaded portion of the hook 18. The hook is appropriately secured to the arm by a pair of nuts, of which the top nut may be an acorn nut, primarily for aesthetic purposes. Macrame cord in turn may be hung from the chain 20, which is in turn hung on the hook 18. Normally, a maximum length of about 18 inches of chain is sufficient. The chain may be shortened, as required, by simply hanging a different link on the hook 18.

Figure 3:
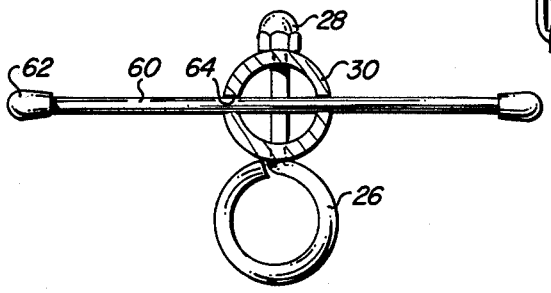
FIG. 3 is a view in partial section of the apparatus of FIG. 1 taken generally along line 3—3 of FIG. 1.

FIG. 3 is a view in partial section of the apparatus of FIG. 1, taken generally along line 3—3 of FIG. 1. It comprises a plan view of the lower tubing 30 above the measuring pin 60. The tubing 30 includes a pair of parallel apertures 64 extending diametrically across the tubing 30, substantially perpendicular to the longitudinal axis of the eye bolt 26, which also extends through a pair of diametrically extending holes or apertures in the tubing 12.

The measuring rod 60 extends through the aperture 64 in the tubing and is freely movable from side to side, as desired. The user may have the measuring pin 60 on one side of the tubing 12 or the other side, depending on the general preferences of the user. In FIG. 3, the pin 60 is shown as being centrally disposed with respect to the tubing 30. Obviously, in use, an asymmetrical orientation of the pin may be desired.

The measuring pin 60 is held in the aperture 64 of the tubing 12 by use of a pair of end tips 62, one of each of which is installed on opposite ends of the pin 60. The diameter of the tips 62 is greater than the diameter of the aperture 64, and accordingly the pin 60 is movably retained with respect to the upper tubing 12.

The eye bolt 26 is secured to the tubing 12 by an acorn nut 28 which is disposed to the threaded portion of the eye bolt 26 remote from the eye of the bolt. The purpose for using an acorn nut is obviously to prevent tears, snags, and the like, should a person venture too near the apparatus, and to prevent a person from being scratched, and the like.

It will be noted from FIG. 3 that the eye of the bolt is disposed relatively close to the tubing 12. This provides more stability and ease of using the table 80 with the eye bolts, as shown in FIG. 4.

It will also be noted from FIG. 3 that the longitudinal axis of the measuring pin 60 is substantially perpendicular to the longitudinal axis of the shank or threaded portion of the eye bolt 26.

Figure 4:
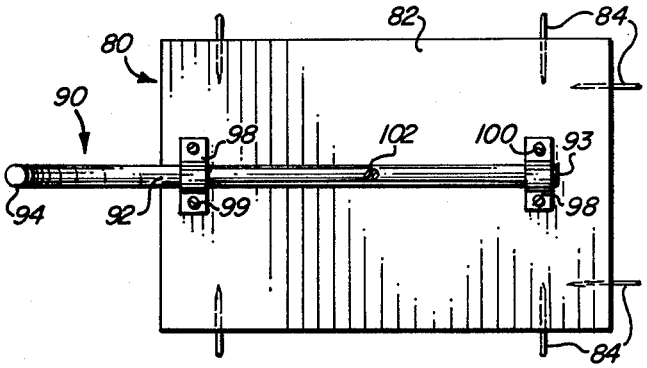
FIG. 4 is a bottom view of a portion of the apparatus of FIG. 1.

FIG. 4 is a bottom view of the table 80, showing how the tubing 90 is secured to the underneath or bottom side of the board 82. A pair of straps 98 are secured to the table by appropriate screws 99 and 100. The straps 98 are used to secure the table to the tubing 90. A screw 102 is used to lock the board 82 to the tubing 92. With the screw 102 removed, the board 82 may be rotated on the tubing 92 to move the board relative to the tubing portion 94 for shipping, storing, and the like. The board 82 may be placed as desired with respect to the long arm 92, as close or as remote from the downwardly and rearwardly extending portion 94 of the tubing 90, as desired, by moving the board relative to the tubing 92 before locking the board and the tubing with the screw 102.

The plurality of L-shaped pins are illustratively shown as screwed into the outer periphery of three edges of the board 82, remote from the tubing portion 94. As shown in FIG. 4, there are preferably two L-shaped pins 84 on each of the side edges and at the front edge of the board, remote from the curved, shorter portion 94 of the tubing 90.

FIG. 5 is an enlarged side view of a portion of the apparatus of FIG. 1, taken generally along line 5—5 of FIG. 1. It discloses a side view of the base 40, shown in partial section, as secured to the horizontal leg 32 of the lower tubing 30.

The horizontal leg 30 is substantially parallel to the horizontal arm 14, but the lower horizontal extending leg 32 may be several inches longer than the upper, horizontally extending arm 14.

The base 40 is a generally rectangular or square base made out of tubing and secured to the horizontally extending leg 32. For maximum stability, the base 40 should be disposed beneath the leg 32 from below or beneath the leg 32. That is, as is clearly shown in FIG. 5, the base 40 is disposed on a floor, in a typical application, with the horizontally extending leg 32 disposed on top of, and substantially bisecting, the opposite, or parallel sides of the base 40.

A pair of convenient bolts, such as carriage bolts, 42 and 44, extend through coaxially aligned apertures in both the base 40 and the leg 32. The bolt 42 is shown extending upwardly through a portion of the leg 32 adjacent the vertically extending portion of the lower tube 30, while the bolt 44 is shown extending upwardly through the front portion of the base 40, again through aligned apertures in the base and in the leg, remotely from the lower tubing 30. A pair of acorn nuts 43 and 45 are used to secure the bolts 42 and 44 to the leg 32. It will be noted that carriage bolts are illustratively shown herein. Obviously, any particular configuration of bolt may be used, with maximum benefit gained by the use of carriage bolts occurring when the bottom aperture through the base 40 comprises a square hole to receive the square portion of the head of the carriage bolt. The nuts 43 and 45 are shown as acorn nuts, substantially the same as illustrated above in FIGS. 2 and 3 with respect to the acorn nut used with the bolt 8 and the nut 28 of the eye bolt 26. The same reasons are valid and accordingly apply to the use of the acorn nuts for securing the base to the tubing.

Figure 6:
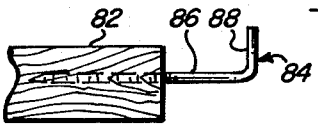
FIG. 6 is an enlarged detail view of a portion of the apparatus of FIG. 1.

FIG. 6 is an enlarged detail view of a portion of the apparatus of FIG. 1, comprising a detail view, somewhat enlarged, of the board 80 and of a pin 84. The pin 84 is an L-shaped pin which includes a relatively large shank 86, the outer portion of which is threaded so as to allow the pin 84 to be screwed into the edge of the table or board 82 a convenient distance. The L-shaped pin 84 includes an upwardly extending arm 88 remote from the threaded portion of the shank 86. The pin 84 may be screwed into the board 82 to an appropriate length so as to locate the arm 88 an appropriate distance away from the edge of the board 82. That is, a macrame board disposed on the board 82 of the table 80 will be located and held between the upwardly extending arms 88 of the pins 84, which are spaced an appropriate distance apart from each other so as to locate the macrame board conveniently and as desired. (See FIGS. 1 and 4.)

Figure 7:
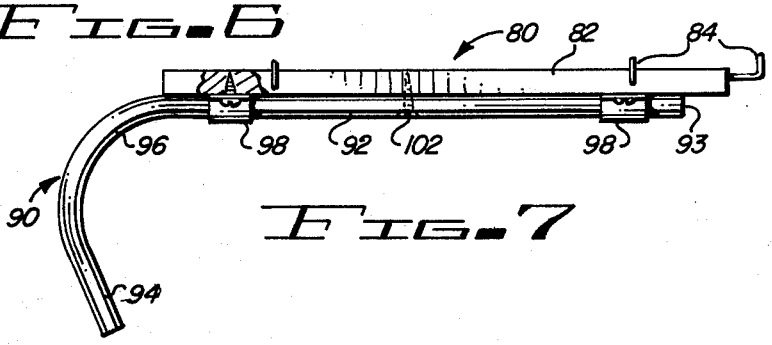
FIG. 7 is a side view of the apparatus of FIG. 4.

FIG. 7 is a side view of the macrame table apparatus 80 removed from the eye bolts 26 and 36 (see FIG. 1). The table 80 includes the board 82 disposed on the relatively longer portion 92 of the tubing 90 and secured to the tubing by a pair of straps 98. A plurality of L-shaped pins 84 are shown secured to the outer peripheral edges of the board 82.

The tubing 90 is bent or shaped so that the short portion 94 is not perpendicular to the long portion 92, but rather the two portions of the tubing are disposed at an acute angle to each other, something less than a right angle. Between the long and the short portions of the tubing is a radius portion 96 which comprises a relatively gentle curving portion. The radius portion defines the angle between the long and the short portions 92 and 94, respectively, and it also cooperates with the spaced apart eye bolts 26 and 36 to allow the board 82 of the table 80 to be adjusted vertically upwardly or downwardly and at a plurality of angles with respect to the vertically extending upper and lower tubing portions 12 and 30, respectively (see FIG. 1).

If the diameter of the eyes of the eye bolts 26 and 36 is slightly larger than the diameter of the tubing 90, with a sufficiently large radius of curvature in the portion 96 in the tubing 90 above the short tubing portion 94, the movement of the table or disposition of the table may be adjusted by moving the short portion of tubing 94 and the radius portion 96 with respect to the eye bolts 26 and 36. For example, the more horizontally the table is desired, the farther down the tubing portions 94 and 96 will be located with respect to the eye bolts 26 and 36. Conversely, the more angle that is desired between the board 82 and the vertically extending tubings 12 and 30, the higher the table 80 will be located with respect to the eye bolts 26 and 36, with the radius portion 96 of the tubing 90 oriented substantially completely away from the upper eye bolts 26 so that the eye bolts 26 and 36 receive only the short portion 94 of the tubing 90. Obviously, there will be a practical limit to the orientation of the table with respect to the radius of curvature of the tubing 90 and the inside diameter of the eye bolts 26 and 36. However, some latitude in orientation may be accomplished by appropriately selecting the size of the tubing with respect to the eye bolts and of bending an appropriately large (or small) radius of curvature between the long and short portions or arms of the tubing.

Generally, it will be noted that the eye bolts 26 and 36 (see FIG. 1), which receive the tubing portion 94 do not extend outwardly from the tubing to such a distance that they interfere with the use of the macrame holder rack when the table 80 is removed from the rack. Rather, the eyes of the bolts are relatively innocuous with respect to the use of the rack when the table is removed. However, when the table is installed, the eye bolts are located at a convenient height from the floor to enable a user of the apparatus to position the table at a convenient height above the floor. Moreover, the single suspension point for the table, only on the vertical tubing, allows the user complete freedom beneath the table for locating a chair, or positioning the user's legs, or the like.

Figure 8:
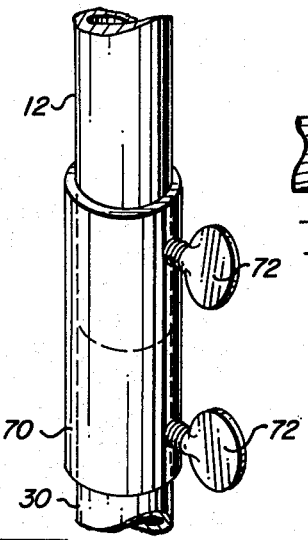
FIG. 8 is an enlarged view of a portion of the apparatus of FIG. 1.

FIG. 8 is an enlarged view of a portion of the apparatus of FIG. 1, comprising an enlarged view of the juncture of the upper tubing 12 and the lower tubing 30. As illustrated, the adjacent ends of the tubing 12 and the tubing 30 are disposed in a sleeve 70, and are secured therein by a pair of thumb screws 72. The sleeve is preferably oriented as shown in FIG. 1, with the thumb screws 72 disposed remotely from the apertures 22. In other words, the thumb screws are on the back of the rack apparatus.

The design of the rack is such that stability is provided inherently regardless of the position or use of any of the pins, hooks, or the table. A user may conveniently be disposed in a chair adjacent the rack or the user may stand at the rack, or may do both, and still have the user's macrame project located conveniently by merely moving the work from one location to another by means of the hook 24 and the apertures 22 in the vertical tubing portions 12 and 30 and the chain 20 hanging from the V-bolt 18 on the arm 14.

The rack may also be taken apart easily for storage, and may be easily assembled for use. The tubing construction also provides inherent strength combined with light weight. However, it is obvious that any appropriate structural material could be used in place of the tubing as illustrated and as discussed.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgaged under the authority thereof.

What is claimed is:

1. Macrame rack apparatus, comprising, in combination, a base;

tubing means secured to and supported by the base, and including a first pair of apertures extending diametrically through the tubing means, a first pin extending through the first pair of apertures and movable in the apertures and defining side to side movement relative to the base and the tubing means, a second pair of apertures extending diametrically through the tubing means spaced apart from the first pair of apertures, a second pin extending through the second pair of apertures substantially parallel to the first pin and movable in the apertures defining side to side movement relative to the base and the tubing means, a plurality of holes in the tubing means spaced apart from each other substantially perpendicular to the first and second pairs of apertures, and a hook for holding macrame cord and insertable into and removable from any of the plurality of holes;

an arm secured to the tubing means remote from the base and substantially perpendicular to the first and second pins;

holding means secured to the arm for holding macrame cord; and table means secured to the tubing means for holding a macrame project and disposed between the base and the plurality of holes.

2. The apparatus of claim 1 in which the holding means for holding macrame cord includes a hook secured to the arm remote from the tubing means.

3. The apparatus of claim 1 in which the tubing means includes means for holding the removable table means below the measuring pins.

4. The apparatus of claim 3 in which the means for holding the removable table means includes a pair of eye bolts secured to the tubing means.

5. The apparatus of claim 4 in which the removable table means includes:

a board for supporting a macrame project, a plurality of L-shaped pins secured to the periphery of the board for holding the macrame project to the board, and tubing, including a first portion secured to the board and a second portion insertable into the eye bolts for securing the table means to the tubing means.

* * * * *